US006595861B1

(12) United States Patent
Morrow et al.

(10) Patent No.: US 6,595,861 B1
(45) Date of Patent: Jul. 22, 2003

(54) INFANT PLAY POOL

(76) Inventors: Sandra L Morrow, 540 Pershing Dr., New Kensington, PA (US) 15068; Pamela A Morrow, 540 Pershing Dr., New Kensington, PA (US) 15068

( * ) Notice: Subject to any disclaimer, the term of this patent is extended or adjusted under 35 U.S.C. 154(b) by 0 days.

(21) Appl. No.: 10/058,201

(22) Filed: Jan. 29, 2002

(51) Int. Cl.[7] ..... A63G 31/12

(52) U.S. Cl. ..... 472/134; 472/128; 472/126; 4/488

(58) Field of Search ..... 472/126, 128, 472/129, 134; 4/488, 494; 446/153

(56) References Cited

U.S. PATENT DOCUMENTS 1,463,125 A 7/1923 Madere
2,124,062 A * 7/1938 Grant et al. ..... 441/40
3,006,705 A * 10/1961 Williams et al. ..... 108/14
3,454,272 A * 7/1969 Elkington et al. ..... 472/126
4,366,963 A * 1/1983 Reeves et al. ..... 280/18.1
4,762,315 A 8/1988 Witter
4,763,895 A 8/1988 Tepper
4,799,910 A 1/1989 Kellough
4,935,970 A * 6/1990 Aristone ..... 4/488
4,962,921 A * 10/1990 Simmons ..... 472/129
5,135,440 A * 8/1992 Smollar et al. ..... 472/128
5,572,750 A * 11/1996 Johnston ..... 4/494
5,772,535 A * 6/1998 Murphy ..... 473/415
6,331,147 B1 * 12/2001 Munro et al. ..... 472/126

* cited by examiner

*Primary Examiner*—Kien T. Nguyen
(74) *Attorney, Agent, or Firm*—Randal D. Homburg

(57) ABSTRACT

The invention is an inflatable children's pool with a centrally located safety seat accommodating a seated infant which may be filled with water or sand to permit a child to safely play at home or at the beach without constant and immediate supervision. The device also includes a detachable shade to shield the seated infant from harmful exposure to the sun.

4 Claims, 2 Drawing Sheets

INFANT PLAY POOL

CROSS REFERENCE TO RELATED APPLICATIONS

None

I. BACKGROUND OF THE INVENTION

1. Field of Invention

The invention is an inflatable children's pool with a centrally located safety seat accommodating a seated infant which may be filled with water or sand to permit a child to safely play at home or at the beach without constant and immediate supervision. The device also includes a detachable shade to shield the seated infant from harmful exposure to the sun.

2. Description of Prior Art

The following United States patents were discovered and are disclosed within this application for utility patent. All relate to play seats for water activity or beach use. In U.S. Pat. No. 4,799,910 to Kellough, a floating ring is disclosed having a central bore containing straps to secure a child within the center of the float, the device also having a retractable sun shade. A ringed envelope for containing the lower torso of a child in a central sack buried within the sand, restricting the child's escape from the buried sack is disclosed in U.S. Pat. No. 4,762,315 to Witter.

The current device is distinguished from this prior art by its inflatable outer ring and central child seat, which, when inflated with the sun shade in place, may contain sand or water allowing the child to play in its own contained, shaded and secure environment without wondering off or being in danger of accidental injury, drowning or over-exposure to the sun.

II. SUMMARY OF THE INVENTION

The primary objective of the invention is to provide a portable device for the secure and safe containment of an infant at the beach or at home, the device being inflatable for compact storage, incorporating a secure central seat for the containment of an infant in a upright seated position for play within the device, filled with toys, water or sand. The perimeter sides extending from the floor of the device contain the sand, water and toys, keeping them close to the infant's access and play.

A second objective of the device is to make the play area within the device having a removable shade to protect the infant from exposure to harmful sunlight. The sunshade may be removed during indoor use and for transport.

The device is also suited for indoor use, as a third objective, allowing for an infant to be placed within the central seat, filling the play area with toys and objects to occupy the attention of the child while containing those objects from being scattered about.

III. DESCRIPTION OF THE DRAWINGS

The following drawings are submitted with this utility patent application.

IV. DESCRIPTION OF THE PREFERRED EMBODIMENT

Figure 1:
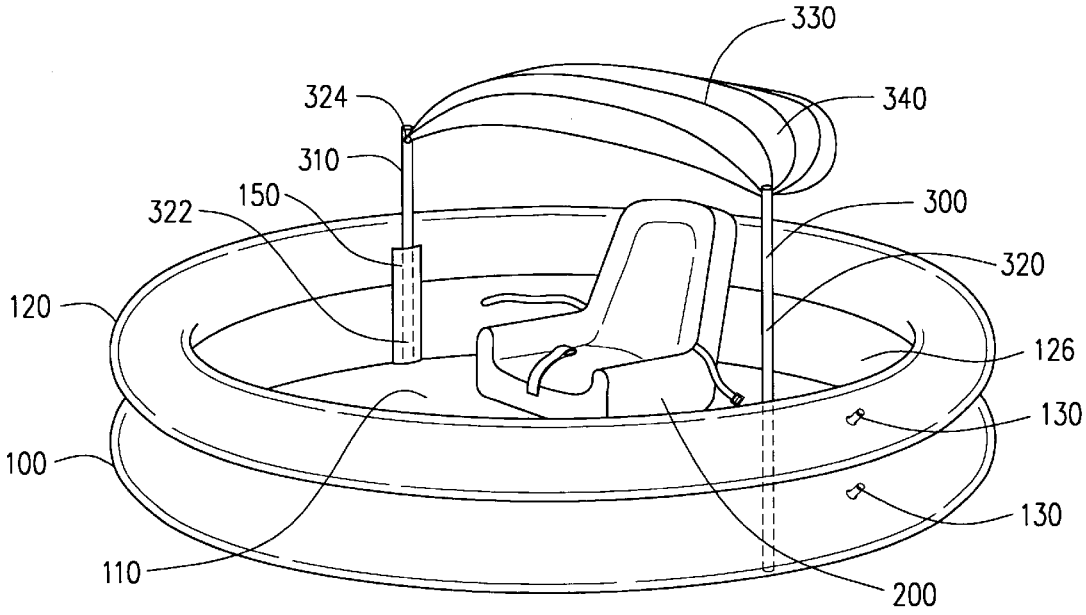
FIG. 1 is a perspective view of the device.
Figure 2:
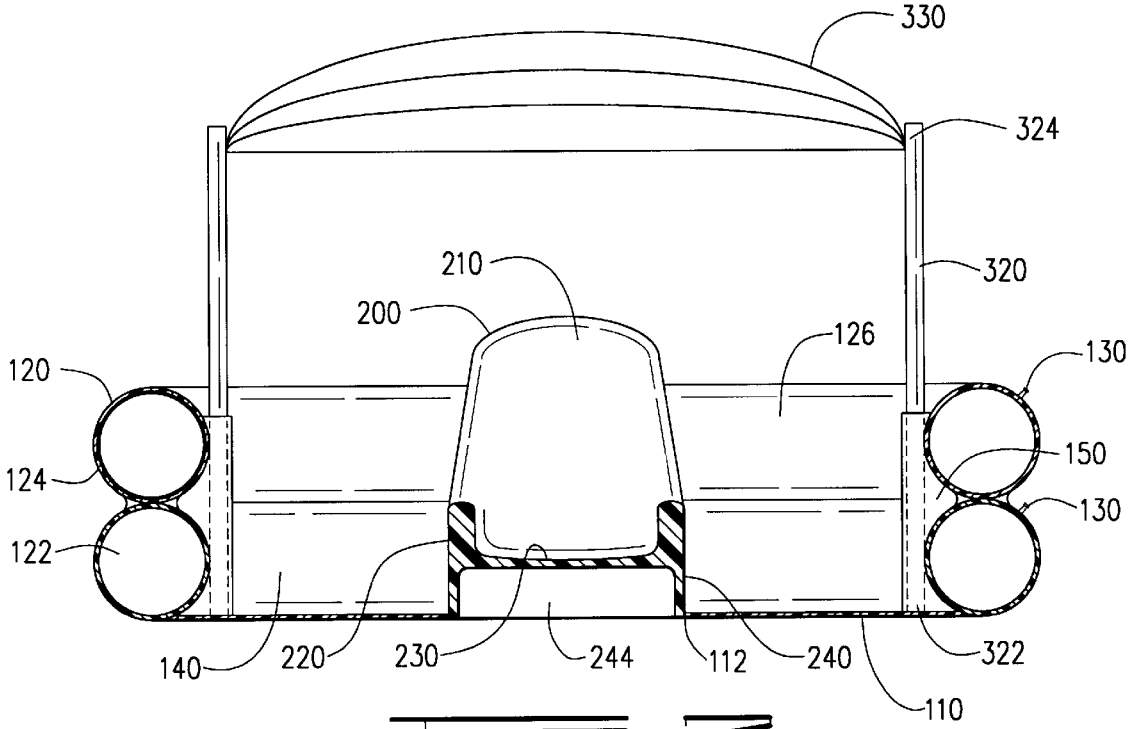
FIG. 2 is a side cutaway view of the device.
Figure 3:
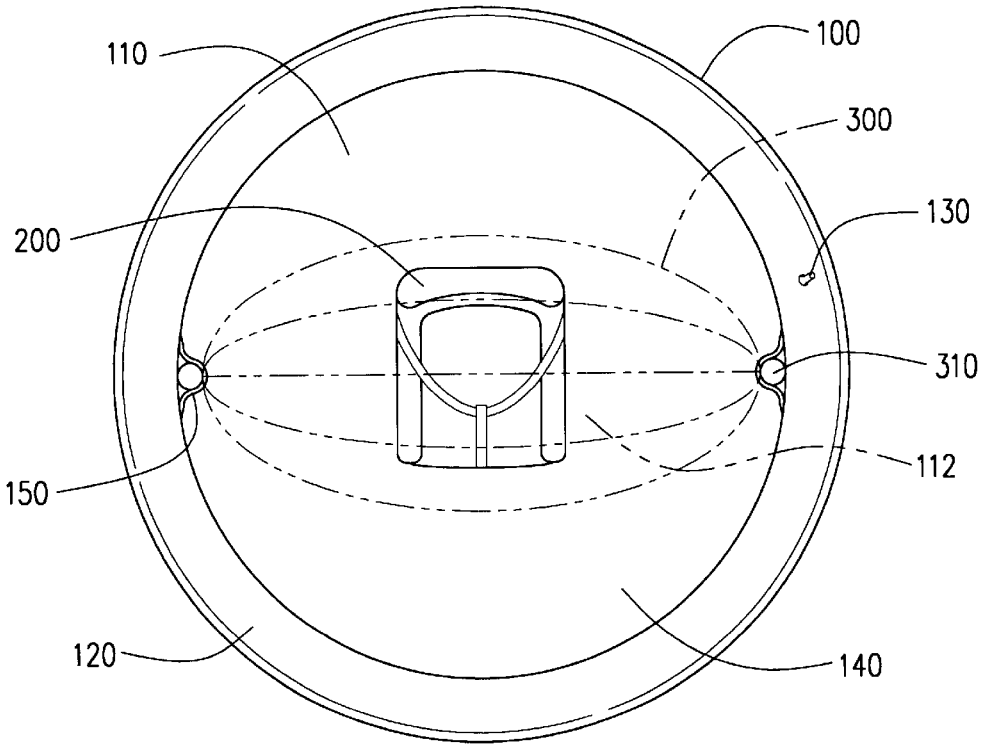
FIG. 3 is a view of the device when deflated.
Figure 4:
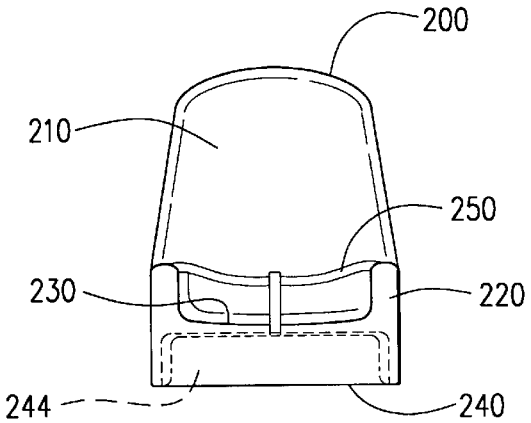
FIG. 4 is a front view of the safety seat.
Figure 5:
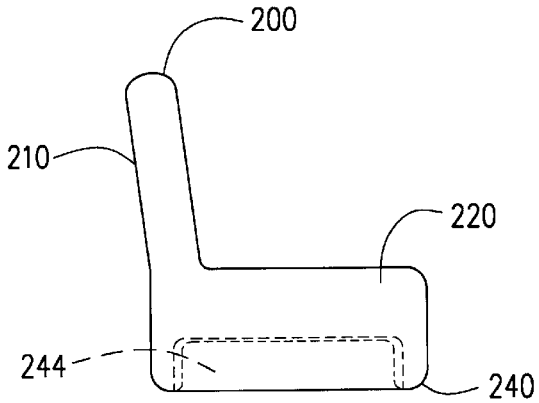
FIG. 5 is a side view of the safety seat.

The invention is an inflatable and portable infant play device comprising essentially an inflatable containment area 100 having a floor 110 and vertical sides 120 with an infant safety seat 200 having a hollow base 240, attached to the floor 110 of the inflatable containment area 100, the inflatable containment area 100 storing within the hollow base 240 of the infant safety seat 200 when deflated for transport or storage. When inflated, the inflatable containment area 100 may be filled with water, sand or toys for accessible entertainment for the infant securely seated within the infant safety seat 200. A detachable sun shade 300 may also be included to protect the infant occupant from exposure to the sunshine if the device is used outdoors.

More specifically, the vertical sides 120 of the inflatable containment area 100 have an inner inflatable chamber 122, an outer surface 124, an air access valve 130 allowing for the introduction of air to inflate the inner inflatable chamber 122 and an inner vertical wall 126. The inner vertical wall 126 and the floor 110 define a play area 140. It is contemplated that the device may contain more than one inner inflatable chamber 122 and more than one air access valve 130. The entire inflatable containment area 100 is made from a water-proof fabric, preferably resistant to mold, mildew, stain and incidental puncture.

The infant safety seat 200 is a singular molded item having a back 210, side portions 220, a seating area 230 and a hollow base 240, the hollow base 240 having a storage cavity 244. The hollow base 240 attaches to the floor 110 of the inflatable containment area 100, preferably in a central portion of the floor 112. The infant safety seat 200 also includes a safety restraint harness 250 to secure the infant within the seating area 230 of the infant safety seat 200 without escape, the safety restraint harness 250 preferably attaching to the hollow base 240 corresponding to a location between the legs of the seated infant, and also attaching to the side portions 220.

When deflated and not in use, the inflatable containment area 100 may be compressed and stored within the storage cavity 244 of the hollow base 240. To utilize the device, a user would remove the inflatable containment area 100 from the storage cavity 244 of the hollow base 240 and inflate the vertical sides 120 of the inflatable containment area 100. After inflation, the user may fill the play area 140 of the inflatable containment area 100 with sand, a shallow level of water or children's toys. The side portions 220 of the infant safety seat 200 should restrict the escape of the infant within, but should not restrict the infant ability to reach the objects or material placed within the play area 140.

During outdoor use, the detachable sun shade 300 may be deployed. The detachable sun shade 300 includes a collapsible frame 310, having a pair of legs 320 including abase portion 322 and an upper hinged pivot joint 324 connecting to a plurality of collapsible folding frame members 330. An impermeable fabric 340, preventing transfer of ultraviolet rays from the sun, is folded over the collapsible folding frame members 330. The base portion 322 of the legs 320 are inserted into pockets 150 provided on the inner vertical walls 126 of the inflatable containment area 100. Monitored adjustment of the upper hinged pivot joint 324 is recommended when the infant is in the infant safety seat 200 to position the detachable sun shade 300 to completely shade the infant occupant during occupancy, accounting for the perpetual movement of the sun overhead.

Another embodiment of the device may be contemplated, although not shown in the drawings, which would include, alternatively, a solid containment area being a singular molded body, having a floor and vertical sides with an infant safety seat having a base, attached to the floor of the containment area. This device could incorporate the same detachable sunshade as the device claimed above, the solid containment area having pockets to accept the base portion of the legs of the detachable sunshade.

While the invention has been particularly shown and described with reference to a preferred embodiment thereof, it will be understood by those skilled in the art that changes in form and detail may be made therein without departing from the spirit and scope of the invention.

What is claimed is:

1. An inflatable and portable infant play device comprising essentially:

a. an inflatable containment area having a floor and vertical sides; and b. an infant safety seat having a hollow base, attached to the floor of the inflatable containment area, the inflatable containment area storing within the hollow base of the infant safety seat when deflated for transport or storage, such inflatable containment area, when inflated and filled with an amount of water, sand or toys providing accessible entertainment for an infant securely seated within the infant safety seat.

2. The device, as disclosed in claim 1, further comprising a detachable sun shade to protect the infant seated within the infant safety seat from exposure to the sunshine when the device is used outdoors.

3. An inflatable and portable infant play device comprising essentially:

a. an inflatable containment area having a floor and vertical sides, the vertical sides having an inner inflatable chamber, an outer surface, an air access valve allowing for the introduction of air to inflate the inner inflatable chamber and an inner vertical wall, the inner vertical wall and the floor defining a play area;

b. an infant safety seat attached at a central portion of the floor of the inflatable containment area, such infant safety seat being of a singular molded construction, having a back, side portions, a seating area and a hollow base, such hollow base having a storage cavity, the infant safety seat also including a safety restraint harness to secure an infant within the seating area of the infant safety seat without escape, the safety restraint harness preferably attaching to the hollow base corresponding to a location between the legs of the seated infant, and also attaching to the side portions, the inflatable containment area storing within the hollow base of the infant safety seat when deflated; and c. a detachable sun shade to protect the infant seated within the infant safety seat from exposure to the sunshine when the device is used outdoors, such detachable sun shade including a collapsible frame, having a pair of legs including a base portion and an upper hinged pivot joint connecting to a plurality of collapsible folding frame members over which is applied an impermeable fabric folded over the collapsible folding frame members, the base portion of the legs inserted into pockets provided on the inner vertical walls of the inflatable containment area, such inflatable containment area, when inflated, provides accessible entertainment for an infant securely seated within the infant safety seat when the play area is filled with an amount of sand, water or toys.

4. The device, as disclosed in claim 3, wherein the device contains more than one inner inflatable chamber and more than one air access valve and the entire inflatable containment area is made from a water-proof fabric, preferably resistant to mold, mildew, stain and incidental puncture.

* * * * *